US006276911B1

(12) United States Patent
Krusche et al.

(10) Patent No.: US 6,276,911 B1
(45) Date of Patent: Aug. 21, 2001

(54) SCREW COMPRESSOR

(75) Inventors: Karl-Joachim Krusche, Sindelfingen; Klaus Hossner, Wimsheim; Wolfgang Sandkoetter, Herrenberg, all of (DE)

(73) Assignee: Bitzer Kuehlmaschinenbau GmbH, Sindelfingen (DE)

( * ) Notice: Subject to any disclaimer, the term of this patent is extended or adjusted under 35 U.S.C. 154(b) by 0 days.

(21) Appl. No.: 09/624,903

(22) Filed: Jul. 25, 2000

(30) Foreign Application Priority Data

Jul. 26, 1999 (DE) ..... 199 35 041

(51) Int. Cl.[7] ..... F03C 2/00
(52) U.S. Cl. ..... 418/201.2
(58) Field of Search ..... 418/201.2

(56) References Cited

U.S. PATENT DOCUMENTS 4,412,788 * 11/1983 Shaw et al. ..... 418/201.2
4,727,725 * 3/1988 Nagata et al. ..... 418/201.2

FOREIGN PATENT DOCUMENTS 0153 169 9/1980 (DE) .
298 536 10/1990 (DE) .
FR-203477-A * 12/1986 (EP) ..... 418/201.2
FR-1566954-A * 3/1969 (FR) ..... 418/201.2
JP-57-206794-A * 12/1982 (JP) ..... 418/201.2
JP-59-119084-A * 7/1984 (JP) ..... 418/201.2
JP-62-000688-A * 1/1987 (JP) ..... 418/201.2
JA-02-248677-A * 10/1990 (JP) ..... 418/201.2
JP-03-015688-A * 1/1991 (JP) ..... 418/201.2
JP-04-058092-A * 2/1992 (JP) ..... 418/201.2
JP-05-157072-A * 6/1993 (JP) ..... 418/201.2
JP-05-187378-A * 7/1993 (JP) ..... 418/201.2

OTHER PUBLICATIONS

*Patent Abstracts of Japan*, Abstract of Japanese Patent No. 6–173872, "Screw Compressor", M–1679, vol. 18, No. 512, Sep. 27, 1994.
*Patent Abstracts of Japan*, Abstract of Japanese Patent No. 1–24193, "Capacity Control Device for Hermetic Screw Compressor", M–824, vol. 13, No. 202, May 12, 1989.

* cited by examiner

*Primary Examiner*—Thomas Denion
*Assistant Examiner*—Theresa Trieu
(74) *Attorney, Agent, or Firm*—Barry R. Lipsitz

(57) ABSTRACT

In order to improve a screw compressor comprising a housing with a rotor chamber, two screw rotors arranged in the rotor chamber, a slide for controlling the capacity adjoining the rotor chamber, an adjusting device comprising a cylinder and an associated control device with which an inflow and a return flow of the medium provided for actuating the cylinder is controllable in a continuous control mode, such that the control device operates reliably, it is proposed that the cylinder chamber comprise a return flow opening and an intermediate return flow opening, and that the control device activate the return flow opening in the control mode for continuous control in a partial control range between an intermediate position and a minimum position, and activate the corresponding intermediate return flow opening defining the intermediate position for continuous control of piston positions outside of the partial control range.

13 Claims, 1 Drawing Sheet

SCREW COMPRESSOR

BACKGROUND OF THE INVENTION

The invention relates to a screw compressor comprising a housing with a rotor chamber, two screw rotors arranged in the rotor chamber, the screw rotors being mounted in the housing for rotation about their respective axes of rotation and being intermeshingly drivable in order to convey a medium to be compressed from a suction gas inlet of the housing to a pressure gas outlet of the housing and thereby compress the medium to be compressed, a slide movable in the direction of the rotor axes and adjoining the rotor chamber for controlling the capacity via the effective length of the screw rotors, an adjusting device comprising a cylinder to which pressure is applied by a medium and which is formed by a cylinder chamber and a piston coupled with the slide, and a control device associated with the cylinder for controlling in an continuous control mode an inflow and a return flow of the medium provided for actuating the piston.

Such screw compressors are known from the prior art. Herein, in an continuous control mode for controlling the adjusting device a supply line is provided for the pressure cylinder, via which the piston is movable into all conceivable positions either by inflow of the medium actuating the piston or by return flow of the medium actuating the piston.

In order that the control device of such a screw compressor will operate reliably, it is, however, necessary to be able to recognize the position of the piston of the control device so as to be able to reliably operate the screw compressor in the mixed control ranges.

For this reason, in a screw compressor known from the prior art a position recognition is required for the piston and/or the slide, which involves expenditure.

SUMMARY OF THE INVENTION

The object underlying the invention is, therefore, to so improve a screw compressor of the generic kind that the control device will operate reliably with a design which is structurally as simple as possible.

This object is accomplished in a screw compressor of the kind described at the outset, in accordance with the invention, in that the cylinder chamber comprises a return flow opening defining a minimum position, the piston being returnable to the minimum position from any position between the maximum position and the minimum position upon activation of the return flow opening, in that the cylinder chamber comprises an intermediate return flow opening defining at least one intermediate position, the piston being displaceable as far as this intermediate position upon activation of the intermediate return flow opening, in that the control device activates the return flow opening in the control mode for the continuous control of the piston position in a partial control range between the intermediate position and the minimum position, and in that the control device activates the corresponding intermediate return flow opening for the continuous control of piston positions outside of the partial control range between the intermediate position and the minimum position.

The advantage of the inventive solution is thus to be seen in the fact that it is possible, by defining the return flow of the medium actuating the piston via the intermediate return flow opening, to operate the piston only in a desired partial control range, and, therefore, to also provide the control device with reliable information to the effect that undesired partial control ranges, for example, the partial control range between the intermediate position and the minimum position can be excluded for the continuous control of the piston.

It is, therefore, possible for a positional monitoring of the piston and/or the slide to be eliminated, but, nevertheless, the control device operates with the necessary reliability, with the control states being recognizable either directly by the kind of control or by detecting the kind of control.

In principle, the inventive solution is fully functional with a single intermediate return flow opening.

It is, however, particularly expedient for several intermediate return flow openings, each defining different partial control ranges, to be associated with the cylinder chamber, and for the control device to define the minimum permissible position of the piston in the respective partial control range by the respectively activated intermediate return flow opening.

This means that with this solution it is possible to define several partial control ranges each with a minimum permissible position of the piston by activating different intermediate return flow openings.

A particularly advantageous control mode provides for the control device to operate the piston exclusively in partial control ranges lying outside of the partial control range between the intermediate position and the minimum position by the control device activating only the corresponding intermediate return flow opening and not, in addition, the return flow opening for the control so that by virtue of the construction it is already possible to exclude the undesired partial control range, for example, the partial control range lying between the intermediate position and the minimum position.

In order to be able to carry out an exact continuous control, it is necessary for the control device to recognize the position of the piston. For this reason, it is preferably provided for the control device to determine the position of the piston starting from the intermediate position corresponding to the activated intermediate return flow opening as reference position, and to thus be capable, starting from this reference position, for example, by integration of the inflow times and return flow times, of determining the position of the piston at least approximately, with an exact new detection of the piston always being possible when the latter is driven back again to the respective intermediate position, from which, as starting point, the position of the piston can then be determined again.

In order to be able to activate the return flow opening and the intermediate return flow openings by the control device, complex valves would, for example, be conceivable. A simple possibility provides for a valve controllable by the control device to be associated with each of the return flow openings and intermediate return flow openings.

The valves could, for example, be designed such that control of the amount is also possible with these. However, in order to design the control device particularly simply, it is preferably provided for each valve to be a valve which is switchable only between a through-flow position and a shut-off position and to thus have only two switching states.

For the structural design of the adjusting device, in particular, to order to attain the minimum position, very different variants are conceivable. It would, for example, be conceivable to act upon the piston on two sides with a medium, with the one medium generating the force for moving the piston from the minimum position to the maximum position, and the other medium generating the returning force for returning the piston in the direction of the minimum position upon activation of the return flow openings or intermediate return flow openings.

Structurally it is, however, particularly simple for the piston to be acted upon in the direction of its minimum position by an elastic energy storing device, for example, a spring, which constantly ensures that the piston moves in the direction of the minimum position upon activation of at least one return flow opening or intermediate return flow opening, insofar as this return flow opening or intermediate return flow opening still opens into the cylinder volume enclosed between piston and cylinder chamber.

For the coupling between the piston and the slide, it would, for example, be conceivable to provide a mechanical transmission or a flexible coupling. However, it is particularly simple for the slide to be connected to the piston via an actuation rod.

Preferably, the slide is rigidly connected to the piston.

However, the inventive solution relates not only to operation of the inventive screw compressor in an continuous control mode.

As an alternative or supplement, to achieve the object of the invention, provision is made in accordance with the invention in a screw compressor comprising a housing and a rotor chamber, two screw rotors arranged in the rotor chamber, the screw rotors being mounted in the housing for rotation about their respective axes of rotation and being intermeshingly drivable in order to convey a medium to be compressed from a suction gas inlet of the housing to a pressure gas inlet of the housing and to compress the medium to be compressed, a slide movable in the direction of the rotor axis and adjoining the rotor chamber for controlling the capacity via the effective length of the screw rotors, an adjusting device comprising a cylinder to which pressure is applied by a medium and which is formed by a cylinder chamber and a piston coupled with the slide, and a control device associated with the cylinder for controlling in an continuous control mode an inflow and a return flow of the medium provided for actuating the piston, for the cylinder chamber to comprise a return flow opening defining a minimum position, the piston being displaceable to the minimum position upon activation of the return flow opening, for the cylinder chamber to comprise an intermediate return flow opening defining at least one intermediate position, the piston being displaceable as far as this intermediate position upon activation of the intermediate return flow opening, and for the control device to activate only the return flow opening or one of the intermediate return flow openings in the stepwise control mode with an inflow which when averaged over time is approximately constant.

The advantage of this solution is to be seen in that owing to the same structural basis, without any conversion measures, it is possible to operate the inventive screw compressor in the stepwise control mode.

In accordance with the invention, the return flow of the medium acting upon the piston, which is made possible by activation of the return flow opening or the intermediate return flow opening, is always greater than the inflow by means of which the piston is movable in the direction of the minimum position.

Herein it is particularly expedient for the control device to activate the inflow in a cycled manner in the stepwise control mode because, in particular, the return of the piston is thereby advantageously initiated, as times are available in which no inflow of the medium acting upon the piston occurs and thus the return flow and the return of the piston in the direction of the minimum position can start in an advantageous way. The response behavior of the capacity control is thus improved.

Herein it is particularly advantageous for the control device to activate the inflow in a fixable cycle.

Furthermore, it is advantageous for the control device to activate the inflow in the fixed cycle for a fixed length of time, with the fixable cycle and the fixable length of time not having to be fixed at the same values throughout the total operating times of the screw compressor, but being readjustable in accordance with changing circumstances, for example, changing operating temperature, in order, for example, in the case of oil as medium acting upon the piston, to carry out an adaptation to the viscosity of the same.

A cycling of the inflow and, in particular, also a cycling of the return flow preferably also take place in the continuous control mode.

Further features and advantages are the subject matter of the following description and the drawings of an embodiment.

DETAIL DESCRIPTION OF THE DRAWING

Figure 1:
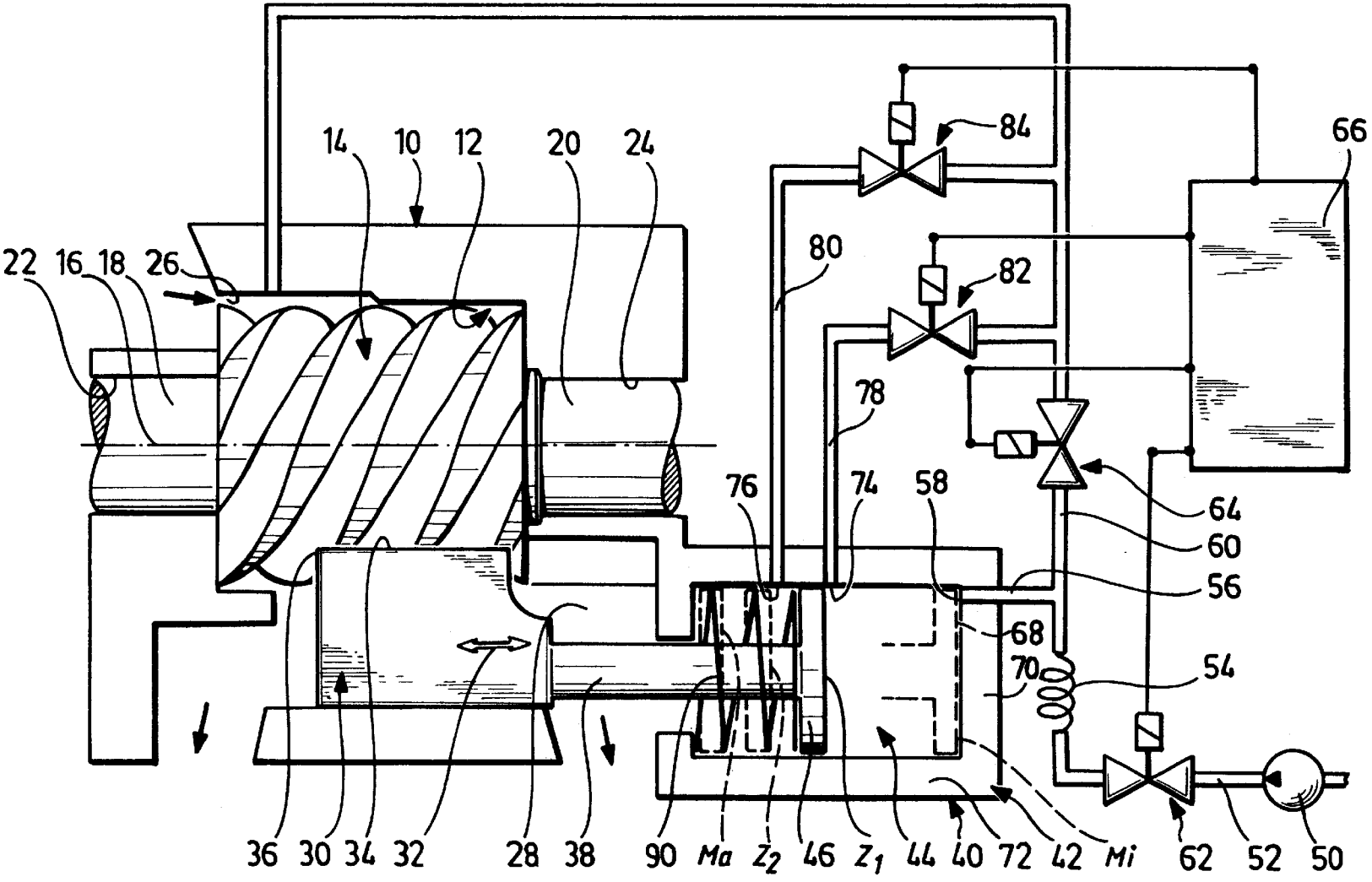
FIG. 1 shows a schematic representation of an inventive screw compressor with a schematic longitudinal section through a housing of the same.

An embodiment of an inventive screw compressor, illustrated in FIG. 1, comprises a housing, generally designated 10, which forms a rotor chamber 12 in which two screw rotors 14 aligned parallel to each other and meshing with each other are mounted for rotation about their respective axes of rotation 16. The screw rotors 14 are preferably mounted by means of shaft stubs 18 and 20 arranged on either side of the same in bearings 22 and 24, respectively, provided in the housing 10.

Also disposed in the housing 10 is a suction gas inlet 26 arranged on the suction side of the screw rotors 14 and a pressure gas outlet 28 lying on the pressure side of the same, and the screw rotors 14 convey a medium to be compressed from the suction inlet 26 to the pressure gas outlet 28 and thereby compress the medium to be compressed.

A slide 30 provided for adjustment of the compressor capacity is mounted in the housing 10 for displacement in a direction 32 parallel to the axis of rotation 16 of the screw rotors 14 and extends from the pressure gas inlet 28 in the direction of the suction gas inlet 26, adjoining with its upper slide side 34 the screw rotors 14 and defining with a front slide edge 36 the place from which compression of the medium to be compressed is carried out by the two intermeshing screw rotors 14.

The slide 30 is fixedly connected to an actuating rod 38 with which the slide 30 is adjustable in direction 32 via an adjusting device generally designated 40.

The adjusting device 40 comprises a cylinder housing 42 enclosing a cylinder chamber 44 in which a piston 46 fixedly connected to the actuating rod 38 is displaceable, with the actuating rod 38 preferably forming a piston rod of the piston 46.

The piston 46 is also displaceable parallel to the direction 32 in the cylinder chamber 44, and, more specifically, from a minimum position Mi, which corresponds, for example, to a capacity in the order of magnitude of 25% of the maximum capacity of the compressor, to a maximum position Ma, which corresponds to the maximum capacity of the compressor, and intermediate positions Z1 and Z2 which will be explained in detail hereinbelow.

The minimum position Mi of the piston corresponds to a minimum cylinder volume enclosed between cylinder chamber 44 and piston 46, and the position Ma to a maximum cylinder volume enclosed between the piston 46 and the cylinder chamber 44, whereas the intermediate positions Z1 and Z2 correspond to cylinder volumes which lie between the minimum cylinder volume and the maximum cylinder volume.

For adjustment of the piston 46, the adjusting device 40 can be acted upon with oil under pressure, which is kept at a pressure required for acting upon the piston, for example, by means of an oil pressure pump 50 or a reservoir acted upon with final pressure of the medium to be compressed. The oil flows from the oil pressure pump 50 through a feed line 52 via a throttle 54, formed, for example, as capillaries, to a supply line 56, which opens with a supply opening 58 into the cylinder chamber 44. The supply line 56 is also connected to a return line 60 which leads to the suction gas inlet 26 of the housing 10.

For controlling individual positions of the piston 46 in the cylinder chamber 44 there is provided in the feed line 52 a feed valve 62, and in the return line 60 a return valve 64, which are both preferably controllable electromagnetically via a control device generally designated 66.

To displace the piston 46 from the minimum position Mi to another position between the minimum position Mi and the maximum position Ma, the feed valve 62 is opened by the control device 66, and the oil pressure pump 50 pumps oil via the feed line 52, the supply line 56 and the supply opening 58 into the cylinder chamber 44 and thus acts upon the piston 46, thereby increasing the cylinder volume, until the desired position of the piston 46 is reached. The feed valve 62 is then closed. The slide 30 can thus preferably be moved into a position in which the compressor capacity lies between the minimum value and the maximum value, the position of minimum capacity of the slide 30 preferably being associated with the minimum position Mi of the piston 46, and the position of maximum capacity of the slide 30 with the maximum position Ma of the piston 46.

To displace the piston 46 from a position between the minimum position Mi and the maximum position Ma in the direction of the minimum position Mi, the return valve 64 is opened by the control device 66 so that oil can flow off from the cylinder volume enclosed by the cylinder chamber 44 and the piston 46 via the return line 60 and preferably flows to the suction gas inlet 26 so that the piston 46 is displaced in the direction of the minimum position so long as the return valve 60 is kept open by the control device 66.

After closure of the return valve 64, the piston 46 remains in the position reached.

To enable setting of all positions between the minimum position Mi and the maximum position Ma, the supply opening 58 is preferably arranged in a cylinder housing bottom 70 of the cylinder housing 42 so as to face a piston base 68.

Furthermore, intermediate return flow openings 74 and 76 are arranged at different spacings from the minimum position Mi of the piston 46 in a cylinder housing casing 72. These are connected to intermediate return flow lines 78 and 80, respectively, which themselves open into the return flow line 60 between the return valve 64 and the suction gas inlet 26. Each of the intermediate return flow lines 78 and 80 is provided with an intermediate return valve 82 and 84, respectively, by means of which the respective intermediate return flow line 78 and 80 is closable.

By the position of the intermediate return flow openings 74 and 76 at a spacing from the minimum position Mi of the piston 46, the position of intermediate positions Z1 and Z2, respectively, of the piston 46 associated with these is defined, and in the case of an continuous control mode the intermediate positions Z1 and Z2 lie such that the piston 46 standing in these stands in front of the intermediate return flow openings 74 and 76, respectively.

By controlling the intermediate return valves 82 and 84 by means of the control device 66, it is now possible to let oil flow out of the cylinder chamber 44 via the intermediate return flow openings 74 or 76 insofar as the respective cylinder volume extends as far as the intermediate return flow openings 74 or 76 or beyond these.

The intermediate positions Z1 and Z2 preferably lie such that the intermediate position Z1 corresponds to a position of the slide 30 in which the screw compressor operates in a mean capacity range, i.e., for example, in the order of magnitude of 50%. Furthermore, the intermediate position Z2 is defined such that, for example, this corresponds to a position of the slide 30 in which the screw compressor operates at a capacity in the order of magnitude of 70% to 80%.

Other fixings of the intermediate positions Z1 and Z2 in a manner in accordance with the invention are, however, also possible. Furthermore, it is also possible in accordance with the invention to provide more than two intermediate positions Z1 and Z2.

In addition, the piston 46 or the slide 30 is preferably acted upon by an elastic energy storing device, i.e., for example, a spring 90, such that both the piston 46 and the slide 30 have the tendency to reduce the cylinder volume, i.e., without acting upon the cylinder volume between piston 46 and cylinder chamber 44 by oil pressure, to go over into the minimum position Mi of the piston 46 and thus the position of minimum capacity of the screw compressor.

The inventive screw compressor is now operable as follows in the continuous control mode:

When starting the screw compressor, owing to the elastic energy storing device 90 and to optional opening of the return valve 64 beforehand, the piston 46 is in the minimum position, and thus also the slide 30, i.e., the screw compressor starts at minimum capacity. If the screw compressor is now to be operated at a higher capacity, the feed valve 62 in the feed line 52 is opened and, consequently, the oil pump 50 conveys oil via the feed line 52 into the supply line 56 and thus via the supply opening 58 into the cylinder volume delimited by the piston 46 and the cylinder chamber 44, whereby the cylinder volume is increased, and the piston 46 moves from the minimum position Mi in the direction of the maximum position.

This increasing of the capacity of the screw compressor can take place up to any possible position of the piston 46.

When a position of the piston 46 between the minimum position Mi and the intermediate position Z1 is reached, this position can be maintained by shutting the feed valve 62, or by opening the return valve 64 this position can be changed again in the direction of the minimum position Mi, with the feed valve 62 closed the minimum position Mi can be approached quickly, and with the feed valve 62 opened it can be approached slowly, insofar as more oil flows off through the return valve 64 than flows in through the feed valve 62.

One does, however, usually endeavor to operate screw compressors in an upper range of capacity, i.e., in a range of capacity above a minimum value in the order of magnitude of 50%.

For this reason, by opening the feed valve 62 in the feed line 52 the piston 46 is usually moved to such an extent that it reaches the intermediate position Z1 or moves beyond this in the direction of the maximum position Ma.

In order to now operate the inventive screw compressor in the upper range of capacity and to be sure that without supervision of the position of the piston 46 and/or the slide 30, these can be prevented from being driven back to such an extent that they reach the lower range of capacity between the intermediate position Z1 and the minimum position again, the control device 66 operates in the upper range of capacity such that in order to displace the piston 46 in the direction of the maximum position Ma it opens the feed valve 62 and thus allows oil to enter the cylinder volume enclosed by the piston 46 and the cylinder chamber 44 via the feed line 52 and the supply line 54.

However, to drive the piston 46 back in the direction of the minimum position, it is not the return valve 64 that is opened but the intermediate return valve 82 in the intermediate return line 78. As a result of this, the piston 46 can only be driven to such an extent in the direction of the minimum position that it reaches the intermediate position Z1 in which the piston 46 stands in front of the intermediate return flow opening 74 and thus upon further movement in the direction of the minimum position automatically shuts the intermediate return flow opening 74 and thus also prevents oil from flowing back from the cylinder volume into the intermediate return flow line 78.

The displacement of the piston 46 to the intermediate position Z1 can be carried out quickly by solely opening the intermediate return valve 82 and slowly by additionally opening the feed valve 62 insofar as more oil flows off through the intermediate return valve 82 than flows in through the feed valve 62.

It is thus automatically ensured that the piston 46 is not moved in the direction of the minimum position beyond the intermediate position Z1. It is thus also recognizable for the control device 66 without supervision of the position of piston 46 and/or slide 30 that the piston 46 is standing in a position which corresponds at least to a capacity of the compressor in the order of magnitude of 50%, but at any rate does not lie below this value. Thus, merely by the control device 66 actuating only the feed valve 62 and the intermediate return valve 82, a control range for the piston is predetermined, which does not fall below the desired value of the order of magnitude of 50%, but lies between the intermediate position Z1 and the maximum position Ma.

If the control range for the piston 46 is to be limited to even higher values, then after adjustment of the piston 46 to at least the intermediate position Z2 the control device 66 brings about only an actuation of the feed valve 62 and the intermediate return valve 84 associated with the intermediate return line 84 so that upon moving in the direction of the minimum position, the piston 46 can only reach the intermediate position Z2 which lies, for example, in the order of magnitude of between 70% and 80% of the capacity of the compressor, and—in the same way as described in conjunction with the intermediate position Z1—upon such an actuation of the intermediate return valve 84 and holding of the return valve 64 and the intermediate return valve 82 in the closed position, owing to the structural arrangement of the intermediate return flow opening 76—a drop below this intermediate position Z2 does not occur without a supervision of the position of the piston 46 being necessary here.

With the inventive screw compressor, however, the control device 66 can operate not only in the described continuous control mode in which in the end a continuous positioning of the piston between the minimum position Mi and the maximum position Ma is possible.

As an alternative thereto, the inventive control device can also operate in a stepwise control mode in which it is possible to access only the intermediate position Z1, the intermediate position Z2 and the maximum position Ma along with the minimum position Mi.

To this end, in accordance with the invention, the feed valve 62 is opened in a fixed cycle for a precisely defined time interval in each case so that the oil under pressure enters the cylinder volume enclosed by the piston 46 and the cylinder volume 44. If both the return valve 64 and the intermediate return valves 82 and 84 are closed, the piston 46 is thereby moved with each feeding of the oil under pressure in the direction of the maximum position Ma so that after a total interval fixed by the time intervals for the feeding of the oil, the maximum position Ma is reached.

If, on the other hand, only the intermediate position Z1 is to be reached, the intermediate return valve 82 is opened, which when the piston is in the intermediate position Z1 results in a slight further movement of the piston 46 beyond the intermediate position Z1 causing the piston 46 to release the intermediate return flow opening 74 and, therefore, the oil fed to the cylinder volume via the supply opening 58 flows off again via the intermediate return flow opening 74 and the intermediate line 78 and so the piston 46 always moves slightly around the intermediate position Z1 and can thus be held in a defined manner therein.

In the same way, it is possible to hold the piston 46 also in the intermediate position Z2 by opening the intermediate return valve 84 and keeping the return valve 64 and the intermediate return valve 82 closed.

Finally, it is also possible to reach the minimum position Mi by the return valve 64 being opened and thus more oil being able to flow off from the cylinder volume than flows in via the feed valve 62 and the throttle 54.

It is also preferable to open the return valve 64 when switching off and before switching on.

For the inventive screw compressor to function in the stepwise or stepped control mode, a precondition is that at least as much oil is always able to flow off via the respective return valves 64, 82 and 84 as can flow in via the feed valve 62. The inflowing amount of oil is preferably adjusted such that it is always less than the amount of oil flowing back via the return valves 64, 82 and 84 when the latter are activated.

Furthermore, by changing the cycle frequency or the respective open time interval of the feed valve 62, the cycled operation of the feed valve 62 makes it possible to vary the amount of oil fed, for example, in the case of a change in the oil temperature or a change in the other conditions affecting the flow behavior of the oil, in particular, when flowing through the throttle 54.

what is claimed is:

1. A screw compressor comprising:

a housing with a rotor chamber, two screw rotors arranged in the rotor chamber, said screw rotors being mounted in the housing about respective axes of rotation and being intermeshingly drivable in order to convey a medium to be compressed from a suction gas inlet of the housing to a pressure gas outlet of the housing and thereby compress the medium to be compressed, a slide movable in the direction of the rotor axes and adjoining the rotor chamber for controlling the capacity via the effective length of the screw rotors, an adjusting device comprising a cylinder to which pressure is applied by a medium, said cylinder being formed by a cylinder chamber and a piston coupled with the slide, and a control device associated with the cylinder for controlling in a continuous control mode an inflow and a return flow of the medium provided for actuating the piston, wherein:

the cylinder chamber comprises a return flow opening defining a minimum position, the piston being returnable to the minimum position from any position between the maximum position and the minimum position upon activation of said return flow opening, the cylinder chamber comprises an intermediate return flow opening defining at least one intermediate position, the piston being displaceable as far as this intermediate position upon activation of said intermediate return flow opening, and the control device activates the return flow opening in the control mode for the continuous control of the piston positions in a partial control range between the intermediate position and the minimum position, and activates the corresponding intermediate return flow opening for the continuous control of piston positions outside of the partial control range between the intermediate position and the minimum position.

2. A screw compressor as defined in claim 1, wherein:

the cylinder chamber comprises several intermediate return flow openings, and the control device defines the minimum permissible position of the piston in the respective partial control range by the respectively activated intermediate return flow opening.

3. A screw compressor as defined in claim 2, wherein the control device operates the piston exclusively in partial control ranges lying outside of the partial control range between the intermediate position and the minimum position, by activating only the corresponding intermediate return flow opening for the control.

4. A screw compressor as defined in claim 1, wherein the control device operates the piston exclusively in partial control ranges lying outside of the partial control range between the intermediate position and the minimum position, by activating only the corresponding intermediate return flow opening for the control.

5. A screw compressor as defined in claim 1, wherein the control device determines the position of the piston on the basis of the intermediate position corresponding to the activated intermediate return flow opening as a reference position.

6. A screw compressor as defined in claim 1, wherein a valve controllable by the control device is associated with each of the return flow openings and intermediate return flow openings.

7. A screw compressor as defined in claim 6, wherein the valve is only switchable between a flow-through position and a shutoff position.

8. A screw compressor as defined in claim 1, wherein the piston is acted upon by an elastic energy storing device in the direction of its minimum position.

9. A screw compressor as defined in claim 1, wherein the slide is connected to the piston via an actuating rod.

10. A screw compressor comprising:

a housing with a rotor chamber, two screw rotors arranged in the rotor chamber, said screw rotors being mounted in the housing about respective axes of rotation and being intermeshingly drivable in order to convey a medium to be compressed from a suction gas inlet of the housing to a pressure gas outlet of the housing and thereby compress the medium to be compressed, a slide movable in the direction of the rotor axes and adjoining the rotor chamber for controlling the capacity via the effective length of the screw rotors, an adjusting device comprising a cylinder to which pressure is applied by a medium, said cylinder being formed by a cylinder chamber and a piston coupled with the slide, and a control device associated with the cylinder for controlling in a continuous control mode an inflow and a return flow of the medium provided for actuating the piston, wherein:

the cylinder chamber comprises a return flow opening defining a minimum position, the piston is returnable to the minimum position from any position between a maximum position and the minimum position upon activation of said return flow opening, the cylinder chamber comprises at least one intermediate return flow opening defining an intermediate position of the piston, the piston is displaceable as far as the intermediate position upon activation of the intermediate return flow opening, and the control device activates only the return flow opening or one of the intermediate return flow openings in a stepwise control mode with an inflow which, when averaged over time, is approximately constant.

11. A screw compressor as defined in claim 10, wherein the control device activates the inflow in cycles in the stepwise control mode.

12. A control device as defined in claim 11, wherein the control device activates the inflow in a fixable cycle.

13. A control device as defined in claim 12, wherein the control device activates the inflow in the fixable cycle for a fixable length of time.

* * * * *